United States Patent [19]

Elsing

[11] 4,023,502

[45] May 17, 1977

[54] PORTABLE SKI TOW APPARATUS

[76] Inventor: John William Elsing, 7202 Shannon Drive, Edina, Minn. 55435

[22] Filed: Oct. 2, 1975

[21] Appl. No.: 619,079

[52] U.S. Cl. ..... 104/173 ST; 248/13; 254/173 R

[51] Int. Cl.[2] ..... B61B 9/00

[58] Field of Search ..... 104/173 R, 173 ST, 183, 104/178, 236; 254/173 R, 175.5, 175.7, 186 R, 147; 248/13

[56] References Cited

UNITED STATES PATENTS

| | | | |
|---|---|---|---|
| 2,599,170 | 6/1952 | Franks | 248/13 |
| 2,608,935 | 9/1952 | Moore et al. | 104/173 ST |
| 2,677,331 | 5/1954 | Hauseman | 104/173 ST |
| 3,161,129 | 12/1964 | Taylor | 248/13 |
| 3,166,021 | 1/1965 | Schippens | 104/173 R |
| 3,184,190 | 5/1965 | Halfinger | 248/13 |
| 3,391,650 | 7/1968 | Goforth et al. | 104/173 R |
| 3,405,651 | 10/1968 | Harmon | 104/173 ST |
| 3,596,607 | 8/1971 | Pomagalski | 104/173 R |
| 3,779,171 | 12/1973 | Littlehorn, Jr. | 104/173 ST |
| 3,809,369 | 5/1974 | Elsing | 104/173 ST |

FOREIGN PATENTS OR APPLICATIONS

| | | | |
|---|---|---|---|
| 1,505,992 | 10/1966 | Germany | 104/173 ST |
| 480,420 | 9/1951 | Italy | 104/173 ST |

*Primary Examiner*—L. J. Paperner
*Assistant Examiner*—Kenneth Noland
*Attorney, Agent, or Firm*—Paul L. Sjoquist

[57] ABSTRACT

Apparatus is disclosed for assisting skiers up ski slopes by means of an endless loop rope, comprising a first portable frame assembly having a rope drive wheel and drive sprocket, a motor drive source which is attachable to the first frame assembly, and a second portable frame assembly having a rotatable rope return pulley, where both frame assemblies have provision for anchoring to the ground and the second frame assembly has provision for spooling and carrying the endless loop rope.

12 Claims, 9 Drawing Figures

FIG. 1
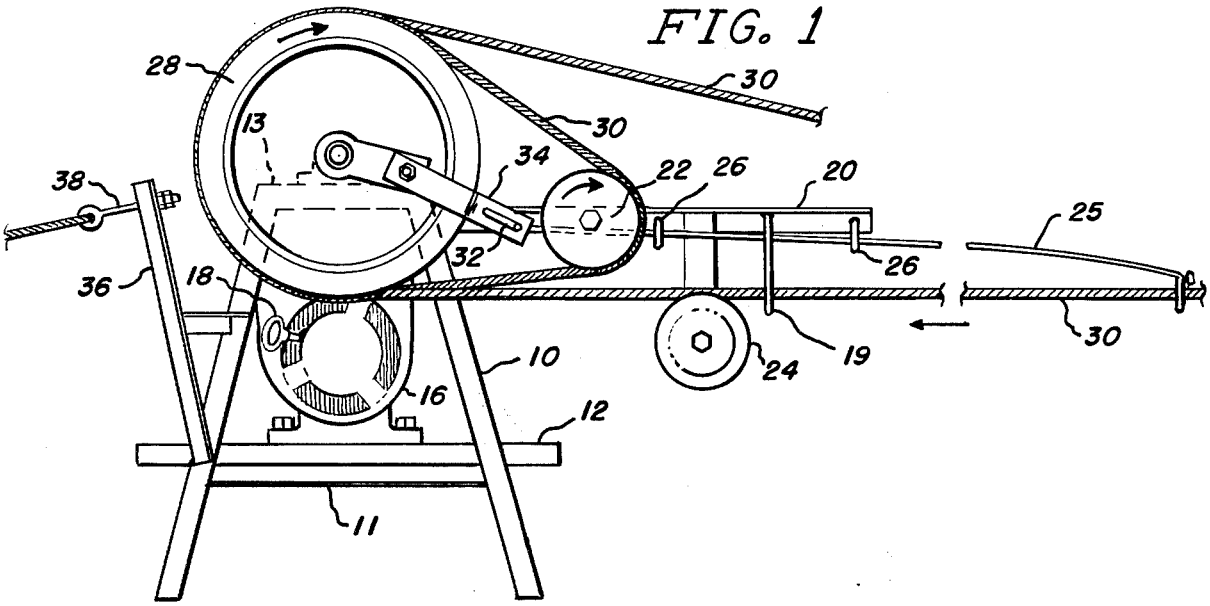
FIG. 2A
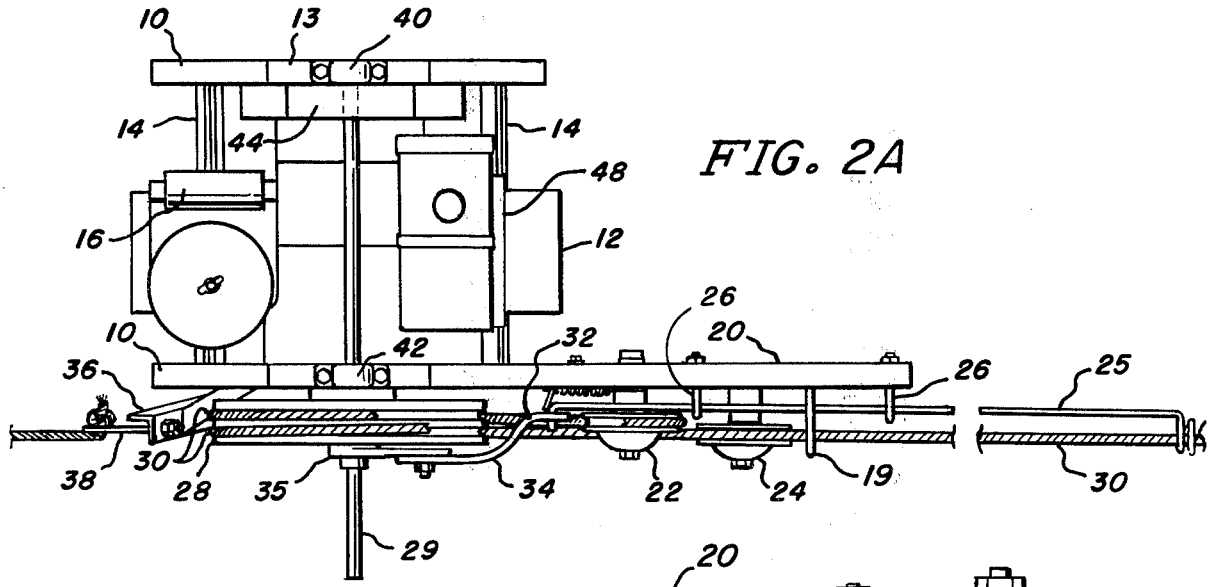
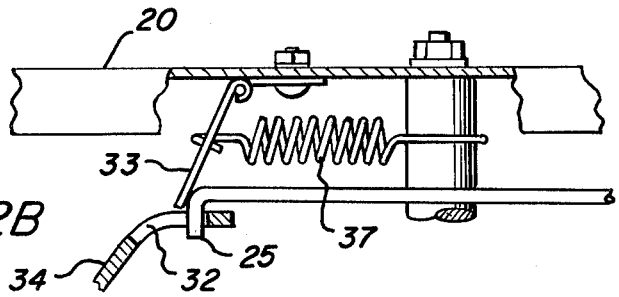
FIG. 2B

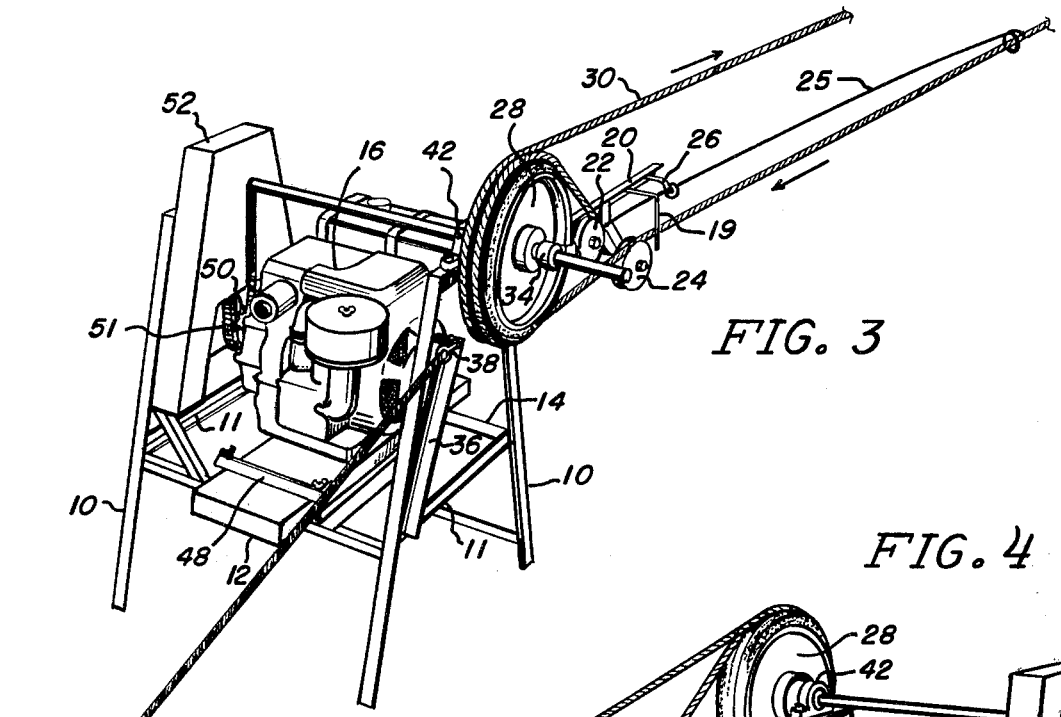
FIG. 3
FIG. 4
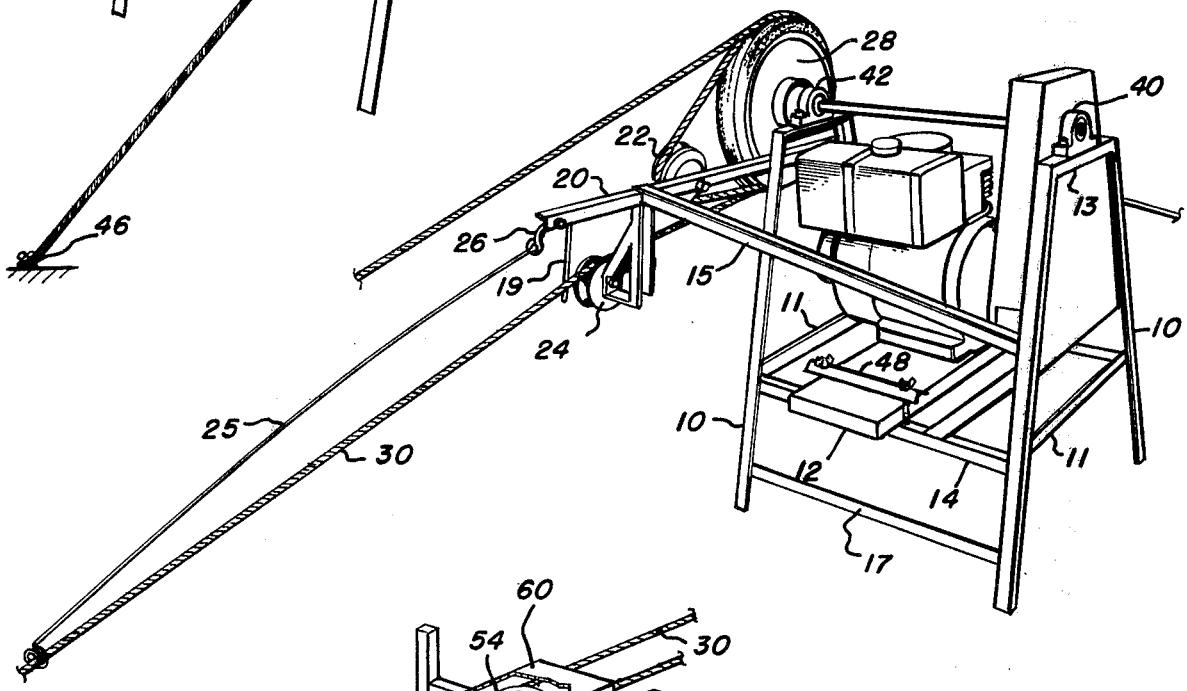
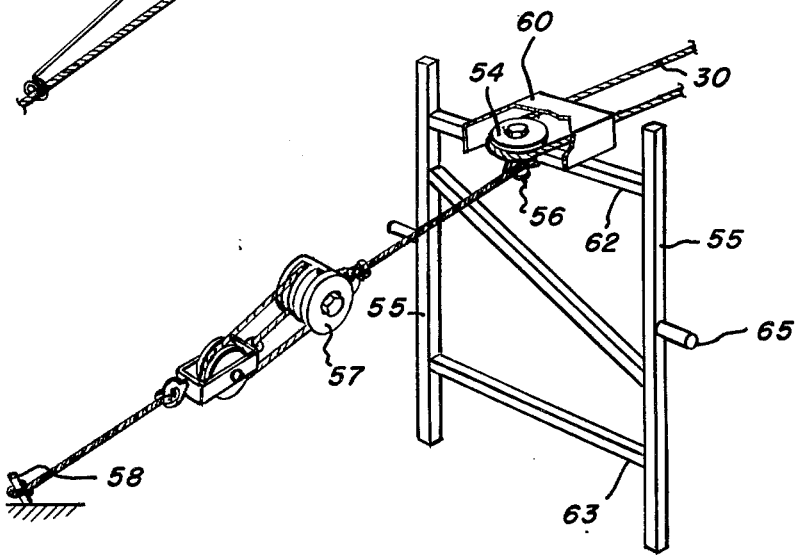
FIG. 5

PORTABLE SKI TOW APPARATUS

BACKGROUND OF THE INVENTION

This invention relates to a ski tow apparatus, and more particularly to a portable ski tow apparatus which is adapted for use with a continuous loop rope tow.

With the sport of skiing gaining in popularity each year, and being participated in by ever wider ranging age and skill groups, it becomes advantageous to provide equipment for towing skiers over intermediate and shorter length ski slopes in order to give these skiers the same advantages of automatic ski lifts that are available in the advanced commercial ski resorts. The task of climbing back to the top of a ski hill one has traversed down may be less difficult in terms of distance covered and elevation climbed when the hill is a short or intermediate length slope, but the number of times a person may proceed up and down such a hill during a day's skiing makes it very desirable to provide some mechanical assistance for the upward climb. Mechanical devices which have attempted to meet this need in the past have been either unduly expensive or burdensome, and have forced the skier who chooses to ski on a smaller, non-commercial slope to climb the hill under his own power.

Furthermore, there are literally hundereds of thousands of intermediate length ski slopes in nearly every region, on both public and private property, which would provide an excellent ski recreation site but for the fact that they are too remotely located or sparsely used to justify the installation of mechanical ski tow equipment. Therefore, skiers who desire the mechanical assist to return them to the top of a ski slope must attend crowded commercial skiing areas at considerable expense and inconvenience to themselves and at some sacrifice to their enjoyment of the sport of skiing.

The present invention, being completely portable in nature, may be transported to any suitable ski slope, and may be set up into operable configuration in a few minutes time, and may be similarly disassembled for return transport when the day's skiing activities are concluded. Conversely, the present apparatus may be installed on a private or public ski slope at the beginning of the winter season and left in place during the entire skiing season, and subsequently disassembled in the spring for storage over the summer months. The economy and simplicity of operation of the invention, as well as its particular novel safety features, enables it to be used by young children on a ski slope that is unattended by any adult. Furthermore, the emphasis is increasing toward a shorter ski for use in conjunction with trick skiing events such as "hot dogging," free style, ballet and jumping, where a fairly short ski run is desirable so that one may quickly repeat an identical ski routine over and over to develop a sense of timing. The present invention is particularly useful to assist in practicing such acrobatic ski routines. The safety features of the invention prevent contact with any moving parts and disable the moving rope tow mechanism whenever a skier comes into too close proximity to the apparatus. One of the safety features used with the present invention is disclosed in my U.S. Pat. No. 3,809,369, issued May 7, 1974.

SUMMARY OF THE INVENTION

The invention comprises a first frame assembly having a rotatable shaft mounted thereon, with a suitable drive pulley and rope tow pulley attached to the rotatable shaft. Means are provided for attaching a rotary power source such as a governor-controlled gasoline engine and gear box to the frame assembly in operative alignment with the drive pulley. The frame assembly has, in alignment with the rope tow pulley, an anchoring member for tying the frame assembly to a ground anchor or to some other fixed object. A second frame assembly is placed in spaced apart relationship, as for example, at the bottom of a ski slope, and has a rotatable return pulley mounted thereon. A closed loop rope is threaded between the pulleys and the respective frame assemblies, and is looped around the drive pulley at least one complete revolution. A safety release arm is attached in engageable and disconnecting position relative to the rope which encircles the drive pulley, and the release arm has connected to it a guide member which completely encircles the rope so that an object or person attached to the rope will deflect the guide member and cause the safety mechanism to engage between the rope and drive pulley and disconnect the rope therefrom.

In a preferred embodiment of the invention a second idler pulley is aligned with the rope drive pulley, and the safety mechanism is arrnaged in engagable contact between the idler and drive pulleys. An additional and supplementary feature of the present invention is a power shutoff feature activated by the guide member to disconnect or shut off the rotary power source whenever the guide member becomes deflected by a moving person or object on the rope.

DESCRIPTION OF THE DRAWINGS

A preferred embodiment of the invention is shown on the attached drawings, in which:

FIG. 1 illustrates the power source frame assembly in side view;

FIG. 2A illustrates the power source frame assembly in top view;

FIG. 2B illustrates the trip rod restraining spring;

FIG. 3 illustrates the frame assembly in rear isometric view;

FIG. 4 illustrates the frame assembly in front isometric view;

FIG. 5 illustrates the return pulley frame in isometric view;

DETAILED DESCRIPTION OF THE INVENTION

Figure 8:
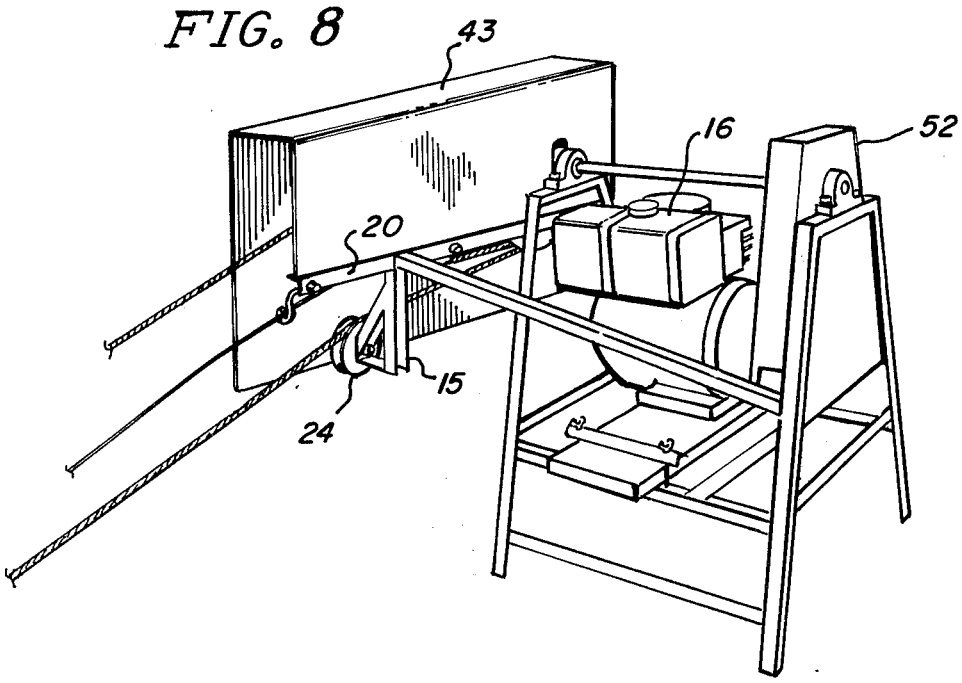
FIG. 8 shows the invention in front isometric view with shield attached.

Referring first to FIG. 1 and 2A, the power source frame assembly is illustrated in side view and top view, respectively. A pair of A-frames 10 are joined together and support an engine mounting platform 12 on their lower horizontal interconnecting struts 14. A-frame 10 has a lower horizontal support member 11 and an upper horizontal support member 13. A power source 16, for example a gasoline powered engine, is securely bolted to platform 12. Power source 16 may be a single cylinder gasoline engine in the horsepower range of 3–12, depending upon such factors as the slope of the hill on which the apparatus is used, the length of the rope tow desired, and the number and weight of the skiers who are to utilize the apparatus. In a typical application wherein the invention is used on a 30% ski slope of approximately 150 yards in length, and up to four young 100- pound skiers use the tow rope simultaneously, it has been found sufficient to use a 5 horsepower (hp), four-cycle gasoline engine. Once selected, the same engine may be used on varying hill slopes and rope tow lengths, but under extreme loading conditions it may be necessary to limit the maximum number of skiers which are towed up a hill at any one time. The power source may be a gasoline engine of the type which is normally started by means of a rope crank starter 18.

Attached to one side of A-frame 10 is an elongated frame member 20. Frame member 20 extends at least several feet toward the downhill side of the apparatus, and serves to provide a mounting base for idler pulley 22, rope guide pulley 24, rope guide arm 19 and trip rod guides 26. Trip rod 25 has a spiral loop encircling tow rope 30 and is guided through trip rod guides 26 to a slot 32 in disabling arm 34. The function of trip rod 25 and disabling arm 34 is described in my U.S. Pat. No. 3,809,369, and its operation will be summarized herein to describe its cooperation with the other features of the present invention.

Tow rope 30 travels through the spiral loop in trip rod 25, over the rope guide pulley 24, around main drive pulley 28, thence around idler pulley 22, and again around main drive pulley 28 before returning to the downhill slope. The arrows indicate the respective normal directions of travel of the tow rope and pulleys.

A frame support member 36 is rigidly attached to the rear side of one A-frame member 10. Frame support member 36 has a tie-down connection 38 for securing the entire frame assembly to a stake or rod in the ground behind the frame assembly. Tie-down connection 38 is aligned along a line which is in a planar extension of the tow rope 30 and main drive pulley 38, and the ground anchor point is preferably positioned along the same planar extension to provide maximum anchoring stability for the frame assembly. This arrangement eliminates any twisting moments to the frame caused by skiers' loading on the rope tow.

Main drive pulley 28 is rigidly affixed to drive shaft 29, which passes through bearing assemblies 40 and 42, respectively, which are attached to a top horizontal member 13 of each A-frame 10. Disabling arm 34 is bolted to a bearing assembly 35 which allows shaft 29 to pass therethrough in freely rotating fashion. A drive sprocket 44 is rigidly attached to drive shaft 29, and is connected via a roller chain drive to a gear box of rotary power source 16. Thus, when power source 16 is activated it causes drive sprocket 44 to rotate shaft 29, which in turn causes main drive pulley 28 to rotate. The rotation of these components, specifically shaft 29, does not impart rotational motion to disabling arm 34 because of its bearing connection 35 with shaft 29.

Idler pulley 22 is bolted to elongated frame member 20, but is mounted on its own internal bearing assembly to permit free rotation thereof. The inward bend of disabling arm 34, including the region of slot 32, passes inside of both segments of rope 30 which track around the lower circumference of main drive pulley 28. This inward mounting position enables disabling arm 34 to disengage both rope segments from operative contact with main drive pulley 28 when trip rod 25 is unlatched from slot 32, as described in more detail in my aforementioned patent. Shaft 29 may be extended for a distance beyond bearing assembly 35 to catch and hold the disengaged tow rope and thereby prevent it from slipping down the ski slope, and also simplifying the rope rethreading operation around the respective pulleys.

FIG. 2B illustrates the trip rod 25 spring restraining mechanism needed to resist the frictional forces of the rope sliding against the trip rod open spiral loop, which forces tend to cause trip rod 25 to move leftward and unlatch from slot 32. A hinged lever 33 is attached to frame member 20 at a point where it contacts the trip rod 25 end that engages slot 32. A tension spring 37 is attached between hinged lever 33 and a convenient anchor point such as the rope guide pulley connection, so as to provide a spring bias force which resists the leftward force caused by tow rope friction. Of course, the force of spring 37 is not strong enough to prevent trip rod 25 from unlatching when a skier comes into contact with the trip rod.

FIG. 3 illustrates the power source frame assembly in rear isometric view. Frame suport member 36 is affixed so as to locate tie-down connection 38 immediately behind and in planar and radial alignment with main drive pulley 28, and aligned with the rope tow travel direction up the ski slope. A ground anchor connection 46 is preferably positioned along this same planar and radial dimension so that the apparatus may be anchored at a point in the same alignment plane as the travel direction of the tow rope. This single anchor point places all of the pulling forces of the tow rope in direct alignment with the ground anchor point 46 and eliminates any twisting or torquing moments to the frame assembly. The elimination of these twisting and torquing forces enables the frame assembly to be constructed of lighter materials than would be the case if the frame design had to be strong enough to compensate for such forces. Of course, this anchoring arrangement contributes significantly to the portability of the entire apparatus, for it enables the use of frame materials which are easily lifted and moved into position on a ski slope.

Another factor which enhances the portability of the apparatus is the manner in which engine platform 12 is secured to horizontal struts 14. A pair of clamping bars 48 are tightened against engine platform 12 by bolts and wing nuts, or other similar fasteners, which connect to struts 14. These clamping bars 48 are easily engageable and disengageable so that the entire engine platform 12 and power source 16 may be removed from the assembly and transported separately to the desired ski slope. Since most of the bulk weight of the apparatus is contained in the mass of power source 16, providing a means for separately transporting it on its platform 12 enhances portability of the entire apparatus. An engine drive sprocket 50 is affixed to the drive shaft and may be engaged with chain 51 by merely adjustably positioning platform 12 in suitable alignment with upper drive sprocket 44. Engine drive sprocket 50 may be slipped into engagement with chain 51, and then engine platform 12 may be slid along struts 14 and clamped at the point where chain tension is optimal. Chain guard 52 is permanently affixed to A-frame 10 to provide a rigid structural shield covering the moving chain drive mechanism.

Main drive pulley 28 is preferably constructed from a solid rubber tire, wherein two rope grooves are machined into the rubber surface to provide a double track for guiding rope 30. For example, I have found that a ten or twelve inch diameter wheel having a solid rubber circumference, with a Shore A durometer of 55–65 has good frictional characteristics when used with a hemp rope, even at subzero temperatures, to provide an ideal drive pulley apparatus for the present invention.

FIG. 4 illustrates the power source frame assembly in front isometric view. Elongated frame member 20 is supported rigidly by one of the A-frames 10, and has a cross support 15 to the other A-frame 10. Rope guide pulley 24 projects downwardly from frame member 20 to provide a freely rotatable guide to insure that rope 30 is aligned and fed to main drive pulley 28. Rope guide arm 19 prevents rope 30 from being pulled off guide pulley 24 when skiers unload from the tow rope and create a lateral rope force as they release the rope. A horizontal support member 17 is connected between the two A-frames 10 at a lower position near the ground. In addition to providing structural support, member 17 prevents the legs of A-frames 10 from vibrating into the ground too deeply as the invention is operated. The height of support member 17 is selected so that the A-frame legs can sink no more than about one inch into the ground.

FIG. 5 illustrates the return pulley frame 55 in isometric view. A freely rotatable return pulley 54 is mounted on shaft 56 and securely affixed to a horizontal cross bar 62 of frame 55. Shaft 56 also serves as a tie point for connecting a block and tackle 57 to ground anchor 58 to the frame member for securely anchoring it to the ground. Ground anchor point 58 is preferably anchored behind frame 55 at a point in alignment with the general direction of rope travel to minimize twisting torques on frame 55. A protective cover 60 encloses return pulley 54 on all except a single side to minimize the danger of personal contact between the rope and pulley.

Frame 55 is further constructed for ease of transport of rope 30 and for loading and unloading the rope from frame 55. Horizontal cross member 62 and 63 are adapted for spooling rope 30 around and between them, utilizing frame 55 as a spool for accumulating excess rope. Handles 65 allow rotation of frame 55 so that they may be grasped, each by an individual, and rope may be wound or unwound from cross bars 62 and 63 by merely holding handles 65 and spinning the entire frame 55. In this manner, the entire length of rope 30 is initially wrapped around frame 55 and is played out from the frame by merely grasping handles 65 and spinning frame 55 while proceeding up or down the ski slope. Frame 55 is then anchored into the ground as hereinbefore described when the rope length plays out, and at an approximate position. Block and tackle 57 is then adjusted to provide the proper amount of rope tension. After the apparatus has been used, the rope may be wound back onto frame 55 by merely reversing the process.

Figure 6:
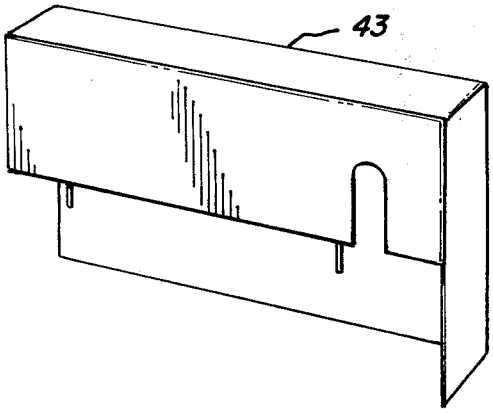
FIG. 6 illustrates the shield used with the invention.

FIG. 6 illustrates a shield and cover 43 which is placed in protective position over drive pulley 28 and the other pulleys and rope guide mechanisms attached to frame 10. Suitable locating holes may be punched or drilled in frame member 20 and elsewhere, to accept the locating pins which are a part of shield 43. Of course, shield 43 is slotted to fit over shaft 29 and has outside dimensions for covering the rope drive and guide mechanisms. FIG. 8 shows the shield 43 in a mounted position on the frame assembly, and demonstrates the protective function to be provided by shield 43.

Figure 7:
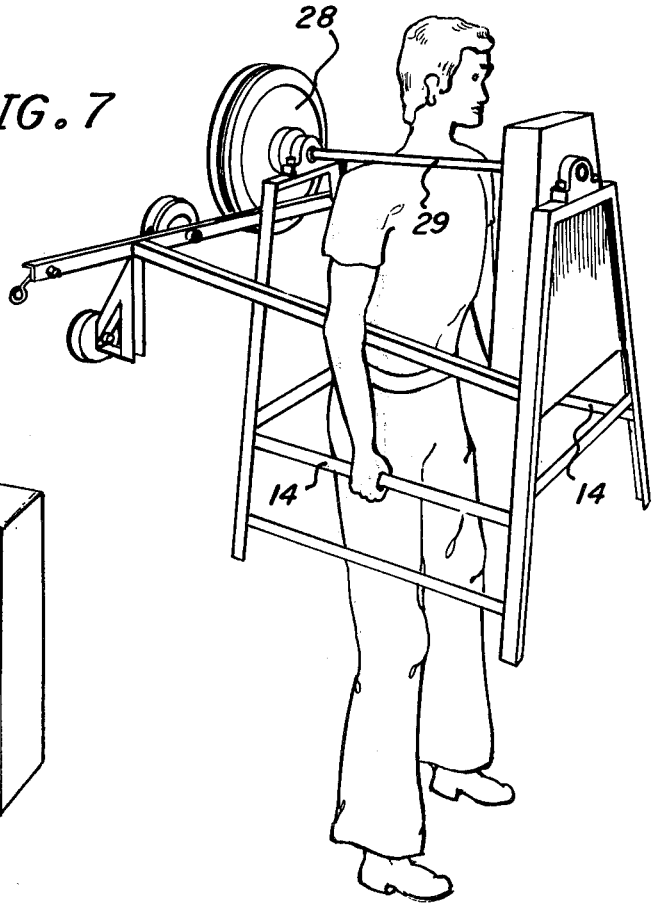
FIG. 7 shows how the frame assembly may be transported.

FIG. 7 illustrates, in pictorial view, how the frame assembly may be transported by grasping struts 14 and resting shaft 29 on the shoulder for support. Of course, the power source 16 is first disconnected from the frame assembly before transporting the frame as shown in FIG. 7.

The operative procedure for the preferred embodiment of my invention requires the interconnection of the three basic and portable components:

a. the power source frame assembly;

b. the engine power source; and c. the return pulley frame assembly and tow rope.

Each of these components is transported to a ski slope; initially, the power source frame assembly is transported to the top of a ski slope and is suitably positioned and anchored to the ground in the manner as hereinbefore described. Next, the power source is transported and coupled into driving connection with the chain and positioned for proper chain tension and alignment and securely tightened against the power source frame assembly. Next, the return pulley frame with rope wound as described is transported to the now affixed power source frame assembly. Several loops of tow rope are unwound from the return pulley assembly and threaded around the drive and idler pulleys, as well as through the trip rod spiral loop and rope guide pulley. Next, the return pulley assembly is transported down the ski slope until all of the rope has been unwound from the frame. Finally, the return pulley assembly is positioned to provide a suitable degree of rope tension and is anchored to the ground as hereinbefore described. The apparatus is then ready for operation, and the engine may be started for immediate utilization of the rope tow on the ski slope. In the event a skier comes into too close proximity to the power source frame the trip rod unlatches from the disabling arm, and the disabling arm causes the rope to become disengaged from the main drive pulley. The power source is then shut off and the rope is rethreaded around the main drive pulley and the trip rod is relatched to the disabling arm. At this point the apparatus may be restarted for continuing use on the ski slope.

Another and optional safety feature which may be incorporated into my invention is an engine shut-off feature which becomes actuated by trip rod 25. It has already been described how trip rod 25 is moved to diable rope engagement from main drive pulley 28 by means of diabling arm 34 whenever a person comes into too close proximity to the main drive pulley assembly. This same movement of trip rod 25 may be coupled, by means of a wire or cable connection, to a grounding bar near the engine spark plug. Utilizing a proper coupling connection, movement of trip rod 25 causes a corresponding movement of the grounding bar to electrically short circuit the spark plug electrode to the engine chassis and thereby to shut off the engine. When the trip rod 25 is subsequently relatched into slot 32 of disabling arm 34 for operable connection, the grounding bar short circuit connection is also removed from the engine spark plug.

The foregoing preferred embodiment of my invention provides a novel and portable ski tow apparatus which may be quickly assembled and disassembled and transported to any convenient ski slope. Variations in construction details may be accomplished to the various features of the invention, but the essential features are disclosed in the following claims.

What is claimed is:

1. A portable rope tow apparatus for a ski slope, comprising:

a. a power source frame assembly having a pair of spaced apart and connected A-frame members, and having a rotatable shaft journaled at the top of said A-frame members and extending outwardly beyond one of said A-frame members, said shaft having a rotatable drive connection affixed thereto and having a rope drive pulley affixed thereto at a position outwardly beyond one of said A-frame members;

b. a power source and mounting base, including means for securing said mounting base to said A-frame members, said power source having a drive connection positionable beneath said shaft rotatable drive connection;

c. an anchor arm attached to said power source frame assembly and having an anchor terminal in planar radial alignment with said rope drive pulley;

d. a guide pulley extension arm attached to said power source frame assembly and elongated toward said ski slope, said arm having a first freely rotatable idler pulley attached thereto in planar radial alignment with said rope drive pulley; and e. a return rope guide pulley frame having legs and cross frame members, and having a freely rotatable return rope guide pulley attached to one of said cross frame members, and having an anchor terminal attached to one of said cross frame members, and having an anchor terminal attached adjacent said return rope pulley.

2. The apparatus of claim 1, wherein said guide pulley extension arm further comrises a second guide pulley positioned in planar radial alignment with said rope drive pulley and closer to said ski slope than said first idler pulley.

3. The apparatus of claim 2, wherein said rope drive pulley further comprises an outer rubber circumferential rim having two parallel rope guide channels therein.

4. The apparatus of Claim 3 wherein said drive pulley guide channels are further comprised of grooves in a resilient material having a durometer of 55–65.

5. The apparatus of claim 4 wherein said drive pulley further comprises a wheel having a solid rubber tire.

6. The apparatus of claim 5, wherein said solid rubber tire is mounted in a vertical plane and said return pulley is mounted in a horizontal plane.

7. The apparatus of claim 1 wherein said power source frame assembly further comprises a bearing assembly mounted on said shaft adjacent said drive pulley; an elongated curved arm attached to said bearing assembly and extending across the alignment path between said drive pulley and said idler pulley; and an elongated movable rod having one end in supportive relationship to said elongated curved arm and a second end having a loop thereon.

8. The apparatus of claim 7, wherein said power source frame assembly further comprises a freely rotatable guide pulley attached thereto, said guide pulley positioned in planar alignment with said drive pulley and having its upper circumference limit at the proximate elevation of said drive pulley lower circumference limit.

9. The apparatus of claim 8, further comprising a shield having means for attaching to said power source frame assembly, said shield having a surface formed so as to enclose at least three sides of said drive pulley, said idler pulley and said guide pulley.

10. A rope tow apparatus for assisting skiers in climbing slopes, comprising;

a. a first frame assembly having a pair of spaced apart A-frame members and a journaled shaft mounted therebetween and extending beyond at least one of said A-frame members, an anchor support member attached to one of said A-frame members and having a connection terminal, an idler pulley, and a rotatable guide pulley aligned with said idler pulley and having its center below said journaled shaft;

b. a drive sprocket attached to said shaft;

c. a rubber-rimmed drive wheel attached to said shaft at an alignment position along the extended portion of said shaft relative to said guide pulley and said idler pulley and said anchor support member, said drive wheel having a solid rubber circumference with a pair of circumferential spaced grooves therein;

d. a motor drive source having a drive sprocket, and having a mounting base intermediate said A-frame members with said respective sprockets in operative alignment;

e. means for driving by interconnecting said drive sprocket attached to said shaft and said drive source drive sprocket;

f. a second frame assembly having a rotatable rope pulley mounted thereon; and g. an endless loop rope extending around said rubber-rimmed drive wheel and said rotatable rope pulley, and extending at least partially around said idler pulley.

11. The apparatus of claim 10, further comprising a rope guide arm extending from said first frame assembly to a position in adjacent alignment with said guide pulley.

12. The apparatus of claim 11, further comprising a cover having means for attaching to said first frame assembly, said cover being shaped to at least partially enclose said drive wheel, said idler pulley, said guide pulley and said rope guide arm.

* * * * *